United States Patent [19]

Savagian

[11] 4,363,401

[45] Dec. 14, 1982

[54] SLEEVE MARKER ASSEMBLY

[75] Inventor: Michael D. Savagian, Milwaukee, Wis.

[73] Assignee: W. H. Brady Co., Milwaukee, Wis.

[21] Appl. No.: 306,045

[22] Filed: Sep. 28, 1981

[51] Int. Cl.[3] ..... B65D 85/20; B65D 63/00

[52] U.S. Cl. ..... 206/345; 206/390; 206/820

[58] Field of Search ..... 206/345, 343, 820, 390; 229/69; 24/17 B, 17 AP

[56] References Cited

U.S. PATENT DOCUMENTS

| | | | |
|---|---|---|---|
| 2,832,712 | 4/1958 | Deinlein et al. | 206/820 |
| 3,229,875 | 1/1966 | Stoller | 206/390 |
| 3,896,524 | 7/1975 | Parker | 206/390 |

FOREIGN PATENT DOCUMENTS

| | | | |
|---|---|---|---|
| 513,038 | 8/1952 | Belgium | 206/820 |

*Primary Examiner*—William T. Dixson, Jr.
*Assistant Examiner*—Brenda J. Ehrhardt
*Attorney, Agent, or Firm*—Quarles & Brady

[57] ABSTRACT

A sleeve marker assembly (10, 50) of sleeve markers (11, 53) formed by a base web (12) and top web (13) joined together by transverse seals (16). The base web and top web are of the same width, and two or more rows of spaced longitudinal slits (18, 21, 51 & 52) extend through both webs to define open ends of the sleeve markers. The sleeve markers are manually detachable from the assembly for application to an article.

4 Claims, 8 Drawing Figures

SLEEVE MARKER ASSEMBLY

TECHNICAL FIELD

This invention is concerned with sleeve markers useful for identifying various types of objects, such as electrical wires, for example.

BACKGROUND ART

Tubular sleeve markers are slipped over an object for use as an identification device, and the markers may be color-coded or carry alpha-numeric information in order to provide the required identification information. A typical use of sleeve markers is to provide individual identification of each electrical wire in a group of wires arranged together in a harness or bundle.

Some prior art tubular sleeve markers are made from plastic tubing cut into sleeves of the desired length. The tubing may or may not be a heat shrinkable material, depending upon the particular end use. Sleeve markers of this type usually are supplied to the customer as a package of individual sleeves, but this has a disadvantage in that a user cannot apply specific identification information to the sleeves at the time they are to be applied to an object. One solution to this problem is that described in U.S. Pat. No 3,894,731. Flattened sleeves are carried on tines extending from a supporting spine. This construction, however, requires modified or special printing equipment to enable a user to apply alphanumeric information to the sleeves and also is a relatively high cost sleeve marking system. Another prior art sleeve marker was sold in the form of a large assembly (11″×14″) consisting of two sheets of vinyl films of equal width sealed together with spaced horizontal seals to form a three dimensional structure of long sleeves that a user was to cut into sleeves of the desired length; the product met with limited acceptance as it was cumbersome and inconvenient for a customer to use.

DISCLOSURE OF THE INVENTION

The present invention comprises an assembly of tubular sleeve markers having a flat base web and a flat top web of the same width joined together along spaced transverse seals, and further including at least two rows of spaced parallel longitudinal slits defining therebetween the opposed open ends of individual sleeve markers. The longitudinal slits are separated from one another by connecting lands of the base and top webs which serve to maintain the structural integrity of the assembly. Individual sleeve markers are manually detachable from the assembly for application to an article. The assembly can include one or more longitudinal rows of sleeve markers.

Various objects of this invention are disclosed in the following description. Some of the main objects were to provide an end user with a convenient sleeve marker system of relatively low cost, and to provide a sleeve marker system that can be readily printed by a user without substantial modification to standard types of printing equipment so that a user can apply customized identification information to individual markers.

BEST MODES FOR CARRYING OUT THE INVENTION

Figure 1:
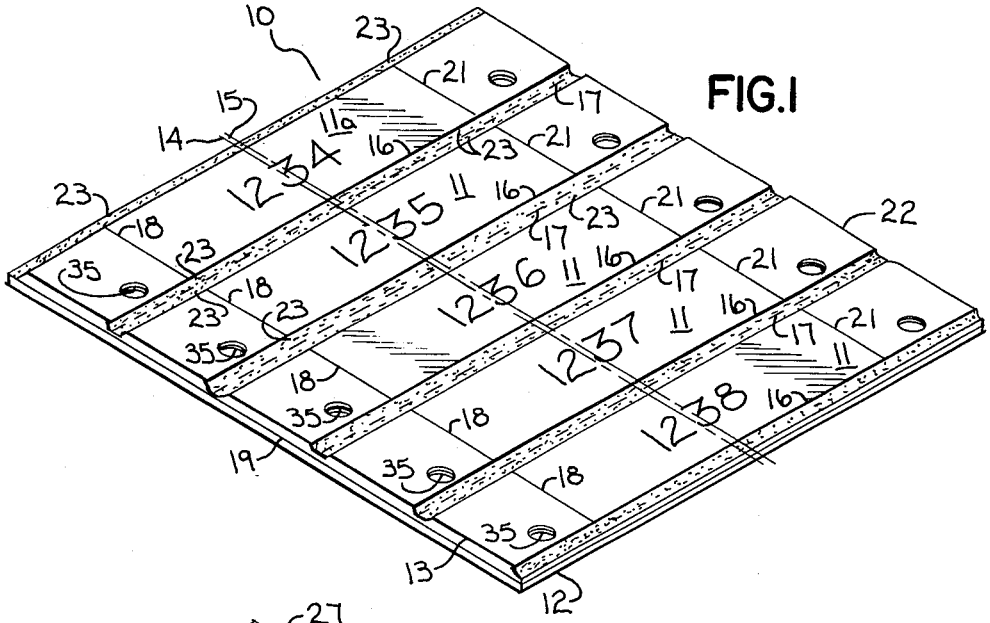
FIG. 1 is a perspective view of a sleeve marker assembly made in accordance with the present invention.

FIG. 1 illustrates an assembly 10 of tubular sleeve markers 11 that incorporates the principles of the present invention. The assembly 10 is made with a base web 12 and a top web 13. The base web and top web are arranged in face-to-face relationship with the longitudinal axis 14 of the base web and the longitudinal axis 15 of the top web arranged parallel to one another. As indicated in the drawing, the two webs are of the same width.

The base web 12 and top web 13 are joined together with a plurality of transverse seals or seal zones 16. The transverse seals 16 are spaced apart from one another at selected intervals or distances sufficient to define the individual sleeve markers 11 of the desired circumferential size. The transverse seals 16 are arranged at right angles to the longitudinal axes of the base web and top web.

Each tubular sleeve marker 11 is to be manually detachable from the assembly 10 along a transverse seal 16. For this purpose, a transverse line of weakness 17 extends across each transverse seal 16, preferably located in the center of the seal. The lines of weakness 17 are illustrated in the exemplary embodiment as a preforated line comprising a series of spaced short slits that extend through the thickness of the base web and top web. Alternate constructions may be employed for the line of weakness, such as score line, a row of circular perforations, etc. The line of weakness is to be of such construction as to permit manual detachment of an individual sleeve marker from the assembly.

Longitudinal slits 18 extend through the thicknesses of both the base web and top web and are formed in a row spaced inwardly from the edge 19 of the assembly. Each slit 18 preferably extends between the innermost edges of each adjacent pair of tranvserse seals 16. A row of similar longitudinal slits 21 is spaced from the slits 18 and arranged inwardly of the opposite edge 22 of the assembly. The slots 18 are spaced from one another a slight distance equal to the width of a transverse seal, and it will be noted that each end of a slit 18 is spaced from a transverse line of weakness 17 a short distance indicated by the numeral 23 with respect to sleeve marker 11*a* in FIG. 1. The ends of each slit 21 are similarly spaced from lines of weakness 17. The spaces 23 thereby form connecting lands between the individual sleeve markers and serve to retain the structural integrity of the assembly 10. Each slit 18 and 21 is illustrated as a continuous slit in the exemplary embodiment, but it may also comprise a series of short spaced slits or a row of perforations, and the term "longitudinal slit" as used in this description and the claims is defined as encompassing all such constructions.

Figure 2:
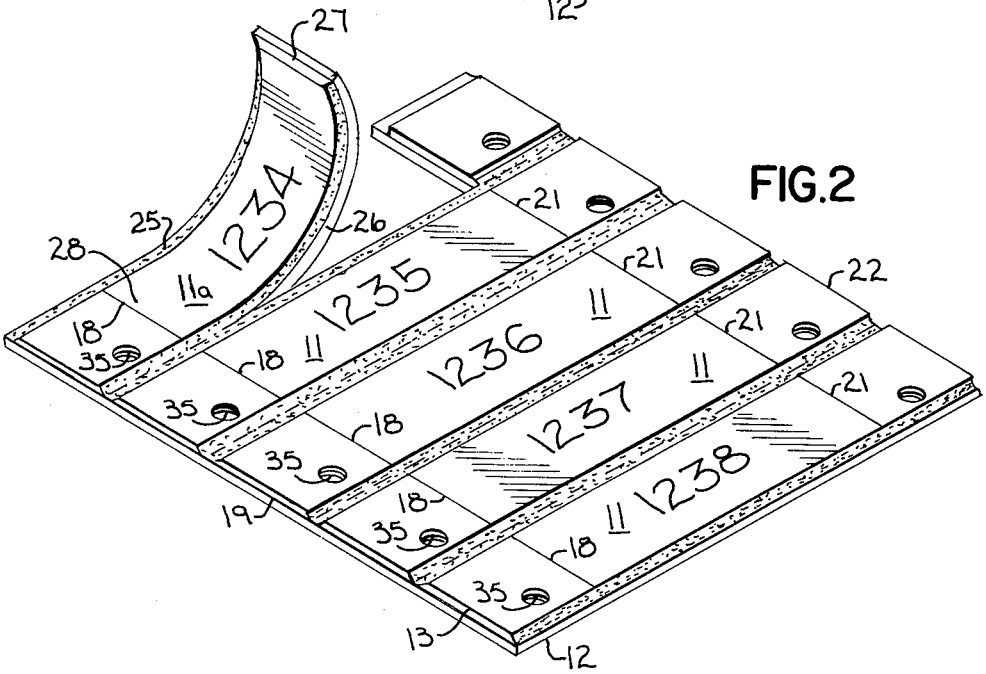
FIG. 2 is a perspective view of the assembly of FIG. 1 illustrating one of the sleeve markers partially detached from the assembly.

Each tubular sleeve marker 11 is to be individually detachable from the assembly 10 by separation along the transverse lines of weakness 17 and breaking away of the lands 23. The marker 11*a* is illustrated in FIG. 2 as being partially detached from the assembly. The sleeve marker 11*a* has closed edge portions 25 and 26 that are formed as portions of an adjacent pair of transverse seals 16. The sleeve marker 11*a* has an open end 27 which is defined by a slit 21 that passes through both the base web 12 and top web 13; similarly, the opposite end of the sleeve marker is an open end 28 defined by a slit 18.

Figure 3:
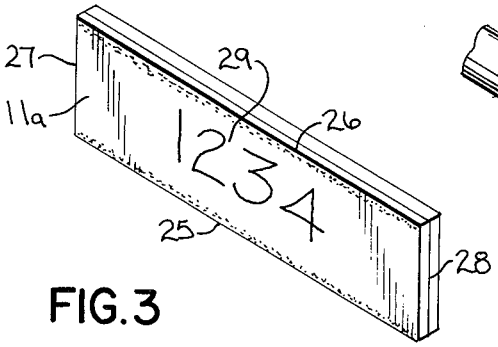
FIG. 3 is a perspective view of an individual sleeve marker fully detached from the assembly of FIG. 1.
Figure 4:
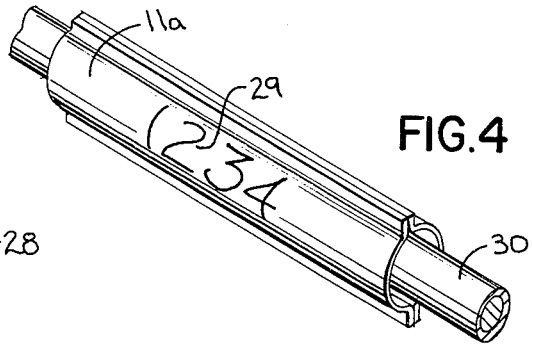
FIG. 4 is a perspective view of the sleeve marker of FIG. 3 inserted on a wire for identification purposes.

FIG. 3 is a perspective view of sleeve marker 11*a* after being detached from the assembly with its various parts identified in accordance with the foregoing description, in which the stippled portions depict its closed edge portions 25 and 26. The sleeve marker 11*a* is ready to be inserted along a wire or other object to be identified as illustrated in FIG. 4. The sleeve marker is in a flattened condition at the time it is detached from the assembly, and it is squeezed slightly so as to open up into a tubular condition to allow the insertion of wire 30.

Each of the sleeve markers 11 can carry an appropriate alpha-numeric identification legend on one or both of its surfaces, such as the numeric legend 29 of the marker 11*a* as illustrated in FIGS. 3 and 4. The legends can be applied by the user of the assemblies 10 by any suitable equipment or pre-printed by the manufacturer. The legends or other identification indicia can be applied by printing, hot stamping, embossment, typing, writing, or other suitable techniques. Also, the markers can be supplied in various solid colors or stripes, with or without indicia, when appropriate for a particular identification use.

A row of evenly spaced apertures 35 is formed within a marginal edge portion of the assembly 10 between the edge 19 and the slits 18. A similar row of apertures 35 is formed along the opposite marginal edge portion of the assembly 10 between the edge 22 and the slits 21. When utilized in the assembly, the apertures 35 are intended for engagement with a web sprocket drive such as associated with line printers used with word processing equipment and computers. This enables automatic equipment to be employed to print suitable alphanumeric indicia on the individual tubular sleeve markers 11. Users of sleeve markers often have a need to custom print a large number of sleeves with sequential or coded identification numbers, and the assembly 10 is suitable for such purposes.

Figure 7:
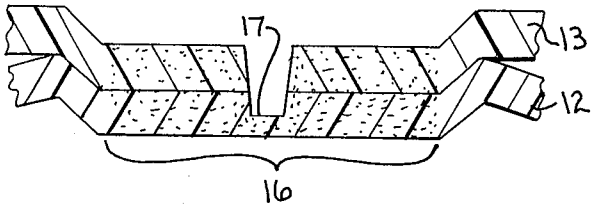
FIG. 7 is a partial sectional view of a transverse seal formed with the apparatus of FIG. 6.
Figure 6:
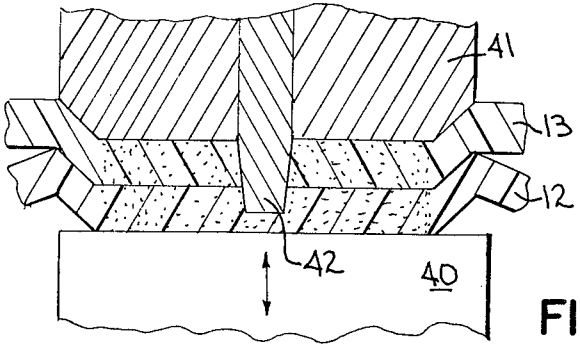
FIG. 6 is a partial sectional view illustrating apparatus suitable for the formation of the transverse seals of the assembly of FIG. 1.

FIG. 6 illustrates a particularly useful apparatus and method for making the transverse seals 16 and FIG. 7 illustrates a seal formed thereby. As shown in FIG. 6, the base web 12 and top web 13 are positioned between the horn 40 and anvil 41 of an ultrasonic sealing apparatus. The anvil 41 has a narrow bar or knife edge 42 projecting from its frontal face which contacts the top web 13. The horn and anvil are connected to suitable ultrasonic apparatus, not shown, of which various types are commercially available that are suitable for sealing sheet materials of the type which may be used for the manufacture of the assembly 10. The seal formed with the ultrasonic sealing means of FIG. 6 is shown in FIG. 7. A transverse seal 16 joins the top web 13 to the base web 12. A line of weakness 17 is formed centrally of the transverse seal 16 simultaneously with the formation of the seal due to the action of the bar 42. The line of weakness 17 is a necked-downed or thinned-out portion of the top web and base web and forms a weakened area along which a transverse seal can be separated manually so that an individual sleeve marker is detachable from the assembly. Ultrasonic sealing is particularly effective for making the transverse seals in the assembly 10 because a narrow seal of high strength can be made, such as on the order of 0.010" to 0.030" wide. However, other means to form the transverse seals for joining the top and bottom webs together can be employed, such as heat sealing, dielectric sealing, etc.

The base web 12 and top web 13 are to be made of flexible sheet materials. Useful materials include flexible thermoplastic films such as polyester films, vinyl films, nylon films and polyolefin films such as polyethylene and polypropylene. One or both of the films may also be made of paper, particularly paper having a polyethylene coating so as to be heat to ultrasonic sealable. The base web and top webs may be made of the same or dissimilar materials, whichever is more suitable for a particular end use. The specific flexible sheet material for making an assembly 10 sould be selected to provide the properties considered necessary for a particular end-use, such as temperature resistance, flame retardancy, solvent resistance, etc. Either the base or top webs, or both, can be made of heatshrinkable materials as well as non-heatshrinkable sheet materials. Many of these film materials are inherently sealable ultrasonically or by heat sealing or dielectric means but, if not, suitable sealable coatings can be applied to the facing surfaces of the top and bottom webs that will be joined together to form the transverse seals 16. The printability of the sheet materials for the webs sould also be considered; if a user is to apply identifying alpha-numeric information to individual sleeve markers such as with a line printer or typewriter, the material for the top web should either be inherently printable or coated with a printable coating in order to provide the desired printability functionality.

Figure 5:
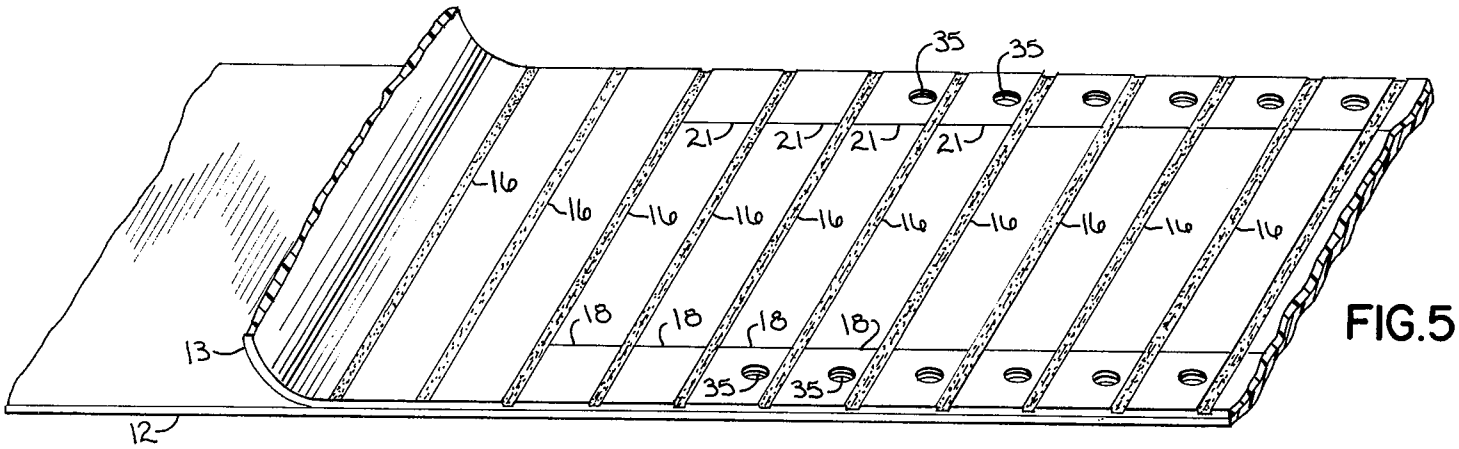
FIG. 5 diagramatically illustrates a method for the manufacture of the sleeve marker assembly of FIG. 1.

A particularly useful method for manufacturing assemblies 10 is illustrated in FIG. 5. A base web 12 is unwound from a supply roll and advanced in a longitudinal direction, top web 13 is fed into position and the spaced transverse seals 16 are formed across the superposed webs to join the top web to the base web. The longitudinal slits 18 and 21 are formed in the two webs, after which the apertures 35 are punched through the two webs along opposed marginal edge portions. The completed article is then advanced for cutting into sheets, winding into a roll or converted to a fan-fold arrangement, whichever is selected.

Figure 8:
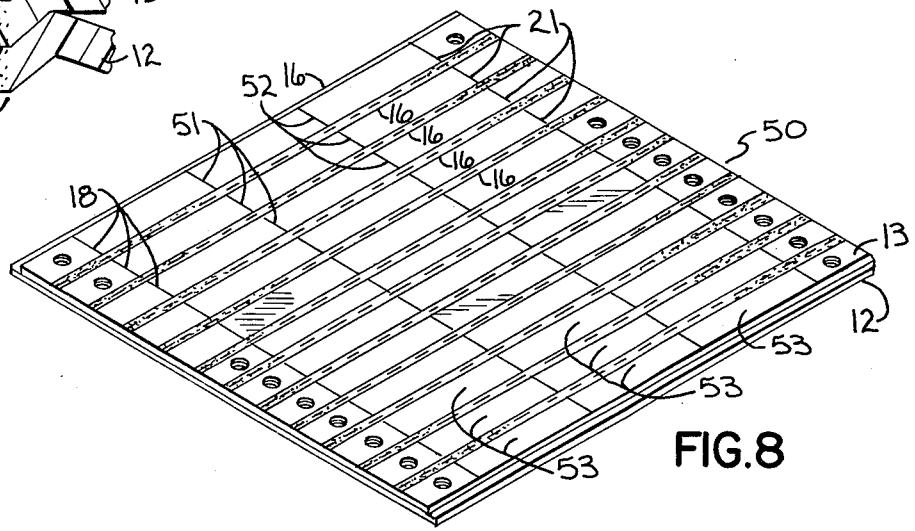
FIG. 8 is a perspective view of a second embodiment of a sleeve marker assembly according to the present invention.

The present sleeve marker assembly can also be made with two or more rows of sleeve markers. FIG. 8 illustrates an assembly 50 of sleeve markers formed by joining base web 12 and top web 13 in the manner previously described. However, in addition to the row of longitudinal slits 18 and row of longitudinal slits 21 near each marginal edge portion of the assembly 50, intermediate rows of longitudinal slits 51 and 52 are cut through the base and top webs parallel to the rows of longitudinal slits 18 and 21. This provides three rows of individual sleeve markers 53 in the assembly, the spacing between the rows of longitudinal slits 18, 21, 52 and 53 being selected so as to form individual sleeve markers of the desired length. The assembly 50 can be made in a manner similar to the method illustrated in FIG. 5. Each sleevemarker 53 is to be manually detachable from the assembly along the transverse seals 16 as discussed above, and the markers are applied to an object as previously described with reference to sleeve marker 11*a*.

Industrial Applicability

The sleeve marker assemblies described above can be employed in various industrial uses for which a tubular sleeve marker is required. Typical uses for the sleeve markers are the identification of individual electrical wires in harnesses such as employed in the aerospace industry, identification of wires assembled in electrical panels, and wire identification in the appliance, shipbuilding and electrical construction industries. The sleeves may also be used for identification of other cylindrical objects, such as pipes, conduits and rods.

The present sleeve marker assemblies have a number of useful advantages. For example, they can be readily advanced through various types of printing equipment, such as programmable typewriters, word processing equipment, line printers associated with computers, hot stamping equipment, etc., so that an end user has a wide choice of equipment to apply selected serialized or other suitable identification indicia to the individual sleeve markers. This can be accomplished with little or no mechanical modification to the widely-used types of printing equipment. The assemblies are furnished to the user as a flat article, thereby further facilitating the handling and printing of the assemblies. Moreover, it is expected that the end user will be supplied with a sleeve marker identification system that is significantly lower in cost than several of the other tubular marker systems currently available in the market place that are adapted for printing of identification data by the end user.

I claim:

1. A sleeve marker assembly comprising, in combination:

(1) a base web and top web superposed upon one another, both webs being of equal width and having longitudinal axes arranged parallel to each other;

(2) a plurality of spaced transverse seals joining the base web and the top web together at preselected intervals, the transverse seals being arranged perpendicular to the longitudinal axes of the base web and top web;

(3) a first row of spaced longitudinal slits defined in a first marginal edge portion of the assembly, each said slit extending through the base web and top web and separated from one another by connecting lands comprising portions of the transverse seals;

(4) a second row of spaced longitudinal slits defined in a second marginal edge portion of the assembly opposite from the first marginal edge portion and arranged parallel to the first row of spaced longitudinal slits, each said slit extending through the base web and top web and separated from one another by connecting lands comprising portions of the transverse seals;

(5) each individual sleeve marker being manually detachable from the assembly and having opposed closed edge portions defined by portions of an adjacent pair of transverse seals and opposed open ends defined by said longitudinal slits.

2. A sleeve marker assembly according to claim 1 further including:

additional rows of spaced longitudinal slits arranged between and parallel to the first and second rows of spaced longitudinal slits to thereby define a plurality of rows of sleeve markers in the assembly.

3. A sleeve marker assembly according to claim 1, further including:

a line of weakness extending across each transverse seal and providing means for manually detaching an individual sleeve marker from the assembly.

4. A sleeve marker assembly according to claim 1, 2 or 3, further including:

a row of spaced apertures formed in the first and second marginal edge portions of the assembly and extending through the base web and top web for engagement with sprocket web drive means.

* * * * *